United States Patent [19]

Crawford et al.

[11] 4,040,367

[45] Aug. 9, 1977

[54] BOBBIN LOW DETECTOR

[75] Inventors: William B. Crawford, Greensboro; Anthony T. Solomon, Reidsville, both of N.C.

[73] Assignee: Burlington Industries, Inc., Greensboro, N.C.

[21] Appl. No.: 609,918

[22] Filed: Sept. 3, 1975

[51] Int. Cl.[2] ..... B65H 63/02

[52] U.S. Cl. ..... 112/273; 200/61.16; 242/36

[58] Field of Search ..... 112/219 R, 219 B, 218 R, 112/219 A; 200/61.16, 61.18, 61.25, 61.13; 242/36, 37 R

[56] References Cited

U.S. PATENT DOCUMENTS

| | | | |
|---|---|---|---|
| 2,647,482 | 8/1953 | Campbell | 112/218 R |
| 2,843,688 | 7/1958 | Masem | 200/61.16 X |
| 2,910,555 | 10/1959 | Tunstall | 112/218 R |
| 3,413,794 | 12/1968 | Bell et al. | 200/61.16 X |
| 3,601,073 | 8/1971 | Simpson | 112/218 R |

*Primary Examiner*—H. Hampton Hunter

*Attorney, Agent, or Firm*—Cushman, Darby & Cushman

[57] ABSTRACT

A device for use with a sewing machine using bobbins to determine either when a predetermined amount of bobbin thread remains on the bobbin or, alternatively, when the bobbin is completely empty. The device employs a probe which is inserted into the bobbin when the sewing machine is not operating and will thereafter produce a signal if the bobbin is low on thread or empty.

13 Claims, 5 Drawing Figures

BOBBIN LOW DETECTOR

BACKGROUND OF THE INVENTION

It is well known in the sewing machine art that, in order for the lockstitch sewing machine needle to effectively stitch pieces of fabric together and to make complete stitches, a bottom stitch be available to interact with the needle thread which secures the needle thread in the fabric. The thread which is essential for this purpose is located on a bobbin which during the sewing cycle or sewing process of the sewing machine is located physically below the throat plate of the sewing machine and is positioned such that the needle thread will be picked up by and intertwined with the bobbin thread to secure the stitches in the fabric.

If the bobbin, for one reason or another, becomes empty there will, of course, not be a bottom thread with which the needle or sewing thread can be intertwined and thus the stitches made during those periods when the bobbin thread is not present will not be held in the fabric and the piece of fabric or material being sewn will have to be re-sewn.

Therefore, it would be desirable to be able to monitor the condition of the bobbin with respect to the amount of bobbin thread remaining and to provide a signal to the sewing machine operator that the bobbin was empty or that there was a predetermined amount of bobbin thread remaining on the bobbin and that a certain preselected number of additional stitches could be correctly produced with the amount of bobbin thread which remains on the bobbin. This is, of course, desirable in any commercial sewing operation, but it would be likewise desirable to have this indication present in non-commercial uses.

The ability to inform the operator that a certain amount of material or thread remains on the bobbin is of critical importance in those sewing operations where predetermined lengths are being sewn on an intermittent basis with a certain amount of bobbin thread being required for each stitch cycle. If the amount of bobbin thread remaining on the bobbin could be determined, the operator could be informed when there was a sufficient amount of material to perform two or three more sew cycles. In this way the operator would be given some leeway as to when the bobbin would have to be replaced and yet she would not have gotten to the point of having run out of bobbin thread which would require some amount of re-sewing.

The present invention provides a device and method for determining when a bobbin has run out of thread and additionally for determining when a specific amount of bobbin thread remains on the bobbin. The device is coupled to the foot switch operated by an operator of the sewing machine so that when the foot switch is raised, de-energizing the sewing machine motor and thus stopping all sewing activity, a probe is inserted in the side wall of the bobbin housing and the bobbin spool is itself grounded. If the probe touches the hub of the bobbin spool, a circuit will be completed through a signalling device which will then indicate to the operator that the bobbin has run out of bobbin thread and that a new bobbin needs to be provided. The probe device can also be provided with a back pressure sensing switch which can be adjusted along the length of the probe shaft and preset so that the back pressure switch is actuated when the needle reaches a preset depth within the bobbin housing. If the needle stops before reaching the preset depth, the pressure switch will not be tripped which will not make any indication that the bobbin is running low on the amount of thread remaining thereon. If the probe does, however, reach at least the preset point, the pressure switch will be closed and indicate that only a certain amount of bobbin thread remains on the bobbin from which the operator can then determine whether additional sewing cycles can be made or whether a new bobbin needs to be placed in the machine.

IN THE DRAWINGS

Figure 1:
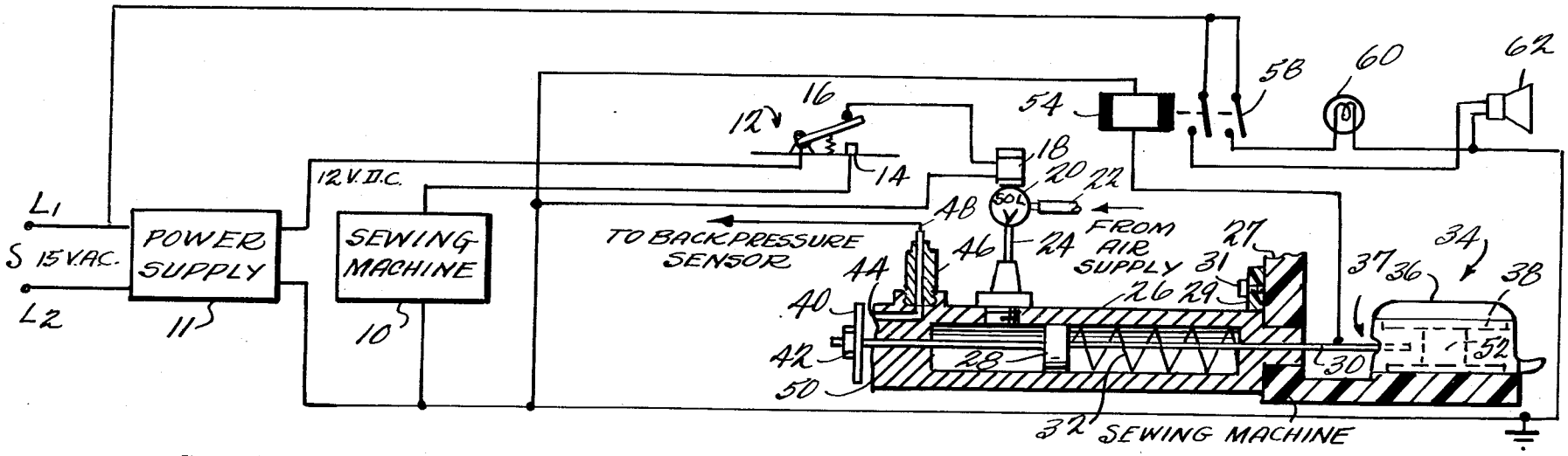
FIG. 1 shows a diagrammatic view of the bobbin low detector of the present invention and shows an air actuated probe and the back pressure sensor switch.
Figure 3:
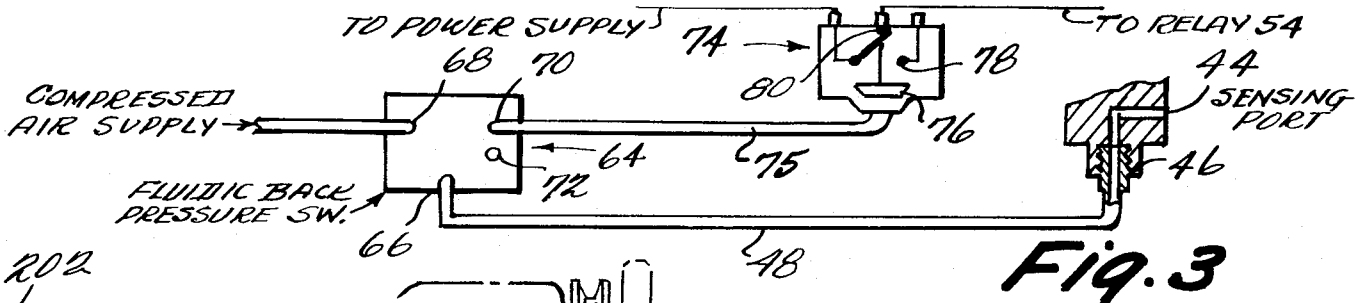
FIG. 3 shows a back pressure switch which can be used with the sensing apparatus shown in FIG. 1 to produce an output signal.

Referring first to FIG. 1, a sewing machine 10 is connected to a source of power indicated by the terminals L1 and L2 through a power supply 11 and a foot switch 12 having contacts 14 and 16. Terminals L1 and L2 are connected to 115V AC while the power supply 11, which can be comprised of a conventional transformer and full wave rectifier (not shown), supply 12V DC for use by the device. The foot pedal is spring loaded and when not depressed, as shown, the relay 18 which operates the solenoid air valve 20 will be placed in circuit with the power supply 11. When the foot pedal 12 is depressed, the contact 14 will connect the sewing machine with power supply 11 so that the sewing operation can proceed. By connecting the relay which controls the energization of the probe to the foot pedal which controls the operation of the sewing machine, the possibility of getting the relay energized when the sewing machine is in operation is prevented. If such occurred, the probe and very likely the bobbin and thread thereon would all be damaged due to the movement of the bobbin during the sewing cycle. The solenoid valve 20 is placed in an air line 22 from a suitable air supply, not shown. The air supply in most commercial plants is generally on the order of 60 to 80 pounds per square inch and applicant has found that only 10 pounds per square inch would be required to energize the cylinder which directs the probe within the bobbin housing. The solenoid valve is in turn connected to a line 24 which is connected to the side of a cylinder 26 which is provided with a piston 28, a probe shaft 30 and a return spring 32. The cylinder 26 is suitably secured to the sewing machine 27 as by collar 29 and bolt 31 so as to be aligned with the bobbin generally indicated at 34, which is comprised of a bobbin housing 36 having an opening 37 for the probe shaft 30 and a bobbin spool 38 located within the bobbin housing. The bobbin spool 38 is shown in dotted lines and it will be noticed also that the bobbin housing itself is connected to ground. The rear end of the probe shaft 30 is threaded and has a disc 40 held thereon by any suitable adjusting means such as nut 42. An air port 44 is provided in the rear end of the cylinder housing 26 and is connected through suitable coupling means 46 to an air line 48 which is connected to a back pressure sensor as shown in FIG. 3. When the cylinder 26 is energized by the solenoid valve 20 and relay 18, the probe shaft 30 will be caused to move into the bobbin housing as shown by dotted lines. If the disc 40 were set back far enough so that it would not come in contact with the read wall 50 of cylinder 26, the probe 30 would not be allowed to proceed until it was stopped by the hub 52 of the bobbin spool 38. If the probe touched hub 52, a circuit would be completed through relay 54 which would close contacts 56 and 58 energizing the light 60 and the audible indicating device 62, such as a sonalert.

It should be understood that while a light 60 and an audible indicating device 62 are provided, the contacts 56 and 58 could be used to provide any type of output signal to control any type of indicating device other than as shown at 60 and 62 herein. In particular, should the bobbin low apparatus, as disclosed herein, be used with a sewing apparatus which is under the control of a programmable controller, the output signal from either contact 56 or 58 could be used as an input signal to such a controller to indicate that the bobbin had run out of thread and that the processing should be terminated.

Since the rear portion of probe 30 is threaded, the positioning of the disc 40 by nut 42 is infinitely adjustable. To determine when a predetermined supply of bobbin thread remains on the spool 38 would require that the probe 30 be stopped prior to reaching spool hub 52 by a distance equal to the thickness created by the predetermined quantity of thread. If the probe 30 could not move that predetermined distance due to thread still remaining on the spool 38, then sufficient thread would remain and no signal would be generated. If the probe 30 did move the predetermined distance, as controlled by nut 42, disc 40 would then come into contact with the rear wall 50 of cylinder 26, closing the air port 44.

Turning to FIG. 3, the air line 48 is shown as being connected to a fluidic back pressure switch 64 which is provided with ports 66,68,70 and 72. The air line 48 is connected to the fluidic back pressure switch 64 and port 66 and the back pressure switch 64 is itself connected to a source of compressed air at port 68. The ports 70 and 72 serve to direct air flow to the fluidic electric switch 74 through line 75. Switch 74 is provided with a fluidic actuator 76 and contacts 78 and 80. As indicated, the switch 74 can be connected to the power supply from the sewing machine and contact 80 can be connected to relay 54 in the same manner that the probe 30 is connected to relay 54. When back pressure exists on line 48 due to the closing of the sensing port 44 by the disc 40, the fluidic back pressure switch 65 is tripped so that air from the compressed air supply at port 68 will be directed from port 72 to port 70. The actuator 76 will cause the closing of contact 80 which in turn will energize relay 54 to indicate by means of light 60 and sonalert 62, or any other convenient indicating means, that only a predetermined amount of bobbin thread remains on the bobbin spool 38.

Figure 2:
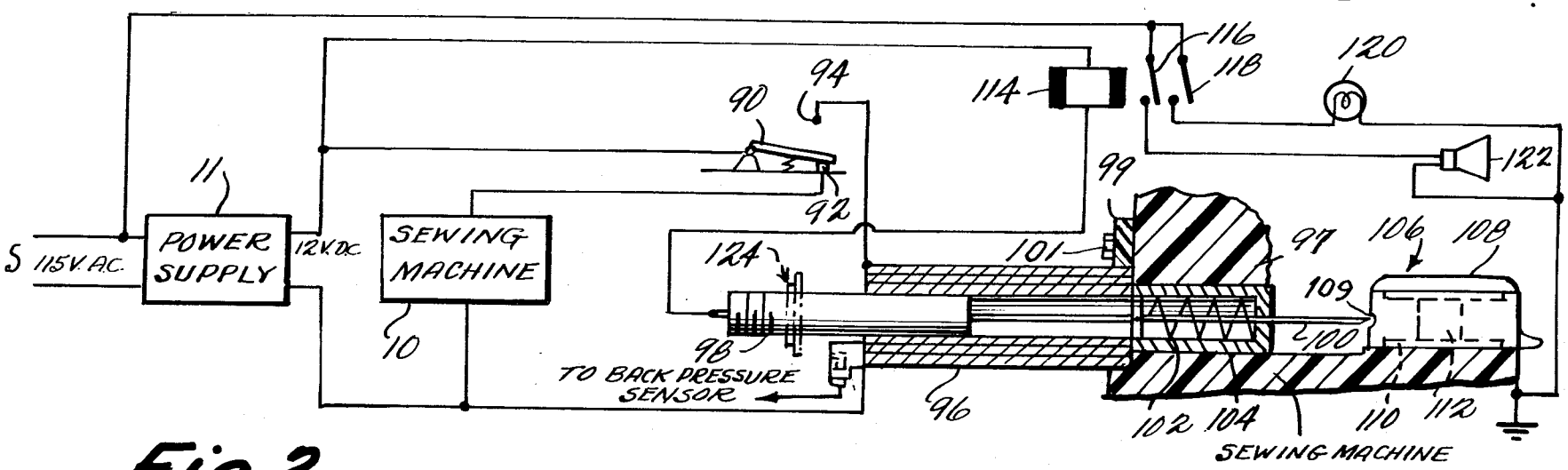
FIG. 2 shows an alternative embodiment of the pressure low detector of the present invention and shows an electrically actuated probe.

Turning now to FIG. 2, a second embodiment of the present invention is set forth. Again, the sewing machine 10 is connected to a suitable power supply 11 through a foot switch 90 having contacts 92 and 94. The foot switch is again spring loaded and, as shown, connects the sewing machine to the source of power through contact 92. Contact 94 would serve in turn to connect the coil 96 to the power supply. The coil 96 is provided with a core 98 having a probe shaft 100 attached thereto. A return spring 102 is provided in an extension portion 104 provided on the end of coil 96. The coil, suitably insulated, is attached to the sewing machine 97 as by collar 99 and bolt 101 so as to have the probe shaft 100 aligned with the sewing machine bobbin assembly generally indicated at 106. The bobbin assembly is comprised of a housing 108, provided with an opening 109 for the probe shaft 100 and a bobbin spool 110 having a hub portion 112. As was the case with the first embodiment, the spool 110 is connected to ground and the probe shaft 100 is connected through the core 98 to a relay 114 which is provided with contacts 116 and 118 which control the actuation of an indicating light 120 and an audible indicating device indicated at 122.

When the foot pedal 90 is released by the operator, the contact 94 will serve to energize coil 96 which causes the core 98 to be pulled into the coil 96, thus causing the probe 100 to be directed within the bobbin 106. As was the case previously, if the probe contacts the hub 112 which is connected to ground, a circuit will be completed energizing the relay 114 which will, in turn, switch contacts 116 and 118, causing the light 120 to be energized and causing the audible indicating device 126 to be actuated so as to advise the operator of the sewing machine that the bobbin has run out of thread. It also should be understood that the back pressure sensor discussed with regard to the device shown in FIG. 1 could also be used with this second embodiment shown in FIG. 2, such as is shown in phantom lines at the rear portion of coil 96.

Figure 4:
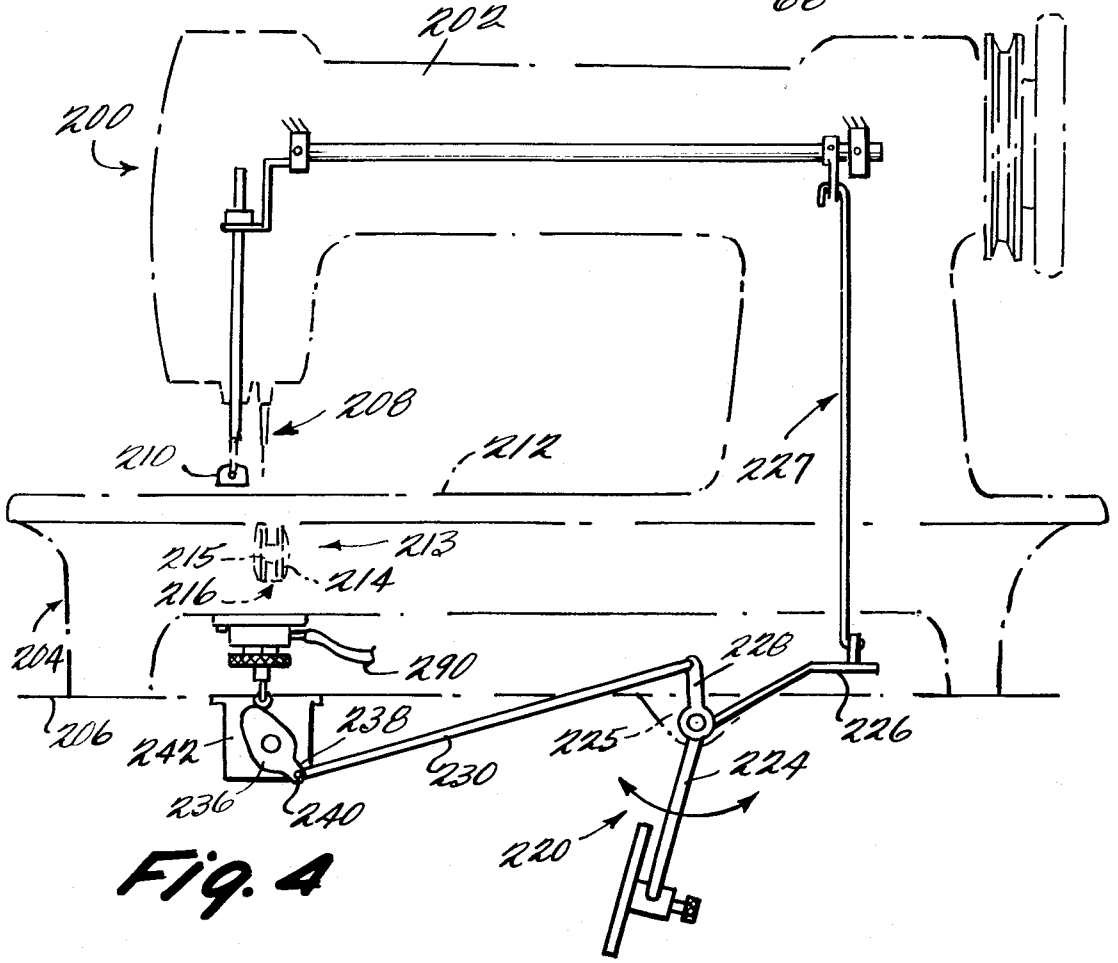
FIG. 4 is a diagrammatic view of a sewing machine having a mechanically operated probe attached thereto.

As shown in yet another embodiment in FIG. 4, a sewing machine generally indicated at 200 consists of a top portion 202, and a bottom portion 204 which is secured to a support surface 206. The sewing machine is provided with a conventional needle assembly 208 and a presser foot 210 which is operated by means of a conventional presser foot lifter mechanism generally referred to at 220. Located below the work surface 212 of the sewing machine 200 is a bobbin assembly 213 which consists primarily of a bobbin housing 214 and a bobbin spool 215. As indicated previously with the other embodiments, the bobbin housing is provided with an opening 216.

Located below the bobbin and attached to the bottom surface 212 of the lower portion 204 of sewing machine 200 is a probe assembly generally referred to at 217.

Still referring to FIG. 4, the presser foot lifter mechanism 220 consists of a knee pad 222 which is connected to a drive shaft 224 which is rotatably mounted to the support plate 206 by means of a bracket 225. The drive shaft 224 has two drive links attached thereto. Drive link 226 drives the presser foot linkage 227 and drive link 228 actuates the plunger assembly 217. The drive link 228 is rotatably connected to a rod 230 by means of a clevis 232 and a pin 234 while rod 230 in turn is rotatably connected to a cam driver 236 by means of a clevis 238 and pin 240. The cam driver 236 is in turn mounted to the support surface 206 by means of a mounting bracket 242 with shaft 244 being secured to mounting bracket 242 and the cam driver 236 being rotatably mounted on the shaft 244, and held thereon by means of a snap ring 246.

Figure 5:
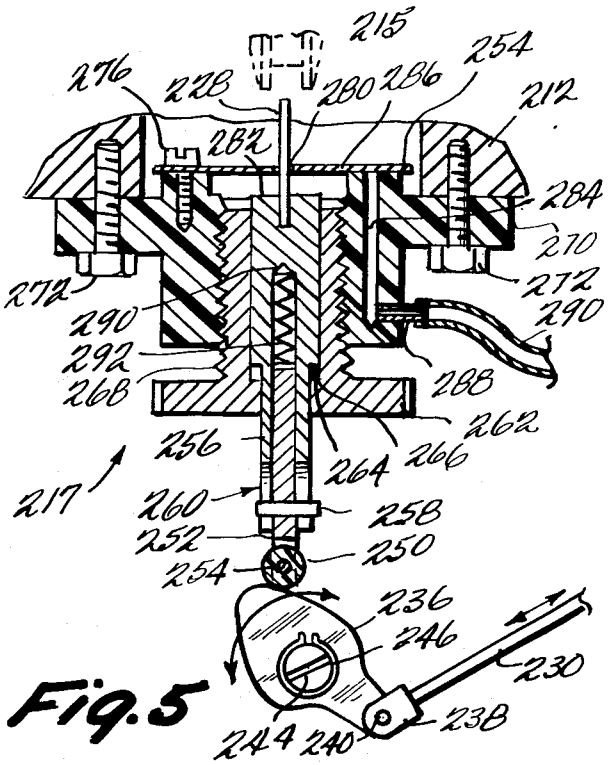
FIG. 5 is an enlarged detail cross-sectional view of the probe member of the present invention shown in FIG. 4.

As more clearly shown in FIG. 5, the cam driver 236, when actuated by the presser foot lifter mechanism 220, will contact a roller cam follower 250 which is secured in shaft 252 by means of a pin 254. The shaft 252 is slidably mounted in the probe member 256 and is retained therein by a pin 258 which is held and moved vertically within slot 260 provided in the probe member 256. This slot allows for cam override should the bobbin spool be filled with yarn. The probe member 256 is slidably mounted within an adjusting knob 262 by means of shoulders 264 provided on the interior side of knob 262 and complementary shoulders 266 provided on the probe member 256, as shown. The knob 262 is threaded as shown at 268 so as to be adjustable within and engage a insulated mounting block 270 which could be made of nylon or any other insulating material. The mounting block 270 is in turn connected to the lower surface of the sewing machine 218 by means of bolts 272.

As indicated, the mounting block 270 is provided with a central opening through which the knob 262 and the probe member 256 can extend. This opening is covered by means of a leaf spring 274 which is secured to the mounting block 270 by means of screw 276. The probe point 278 extends through an opening 280 provided in the leaf spring and the upper portion of the probe member 256 is provided with shoulders 282. A passageway 284 is provided within the mounting block 270 and is provided on the upper and lower ends thereof with extensions 286 and 288, respectively. The upper extension 286 will normally be closed by the leaf spring 274 and the lower extension 288 is connected by means of hose 290 to a back pressure switch similar to that shown in FIG. 3.

The probe member 256 has a hollow core 292 in which shaft 252 slides and a spring 294 is provided in the upper portion of the probe member 256 to act as a return for the shaft 252.

Thus, in operation, when the sewing machine operator activates the presser foot lifter 220, the moving of the drive shaft 224 will cause the drive link 228 to rock the cam 236 so as to move the probe 278 through the opening 216 in the bobbin housing 214 and toward the bobbin spool 215. Depending on the setting of the knob 262 within the mounting block 270, the spacing between the shoulder 282 on the probe member 256 and the leaf spring 274 is variable so that greater and lesser distances will be required to actuate the leaf spring 274 when the leaf spring 274 opens or uncovers extension 286 a back pressure signal will be sent to a fluidic back pressure switch such as is shown in FIG. 3 and indicated generally at 64. As was the case with regard to the previous discussion of FIG. 3, the fluidic back pressure switch would be tripped so that the relay 54 will be energized through contact 80 in switch 74.

As was indicated above, the mounting block 270 is comprised of a nylon or phenolic material as are the mounting blocks 27 and 97, as shown respectively in FIGS. 1 and 2.

It should be understood from the above discussion that any number of convenient methods of energizing the probe to cause it to move in a bobbin housing once the sewing cycle has terminated exists and while only three such methods have been disclosed herein, these are only given as examples. Further, while other arrangements also could be provided to determine when the bobbin had a predetermined amount of thread remaining thereon, the applicant is aware that many modifications could be made to the abovedescribed apparatus without departing from the concepts involved herein and wish only to be limited by the claims appended hereto.

What is claimed is:

1. A bobbin thread low detector for use in a sewing machine which includes a bobbin spool having a central hub, said bobbin spool being mounted in a bobbin housing in which an opening has been provided, said detector comprising a probe slidably mounted within a probe housing, said probe housing being mounted on the sewing machine such that the probe is aligned with the opening in said bobbin housing, means for moving said probe within said probe housing into and out of said bobbin housing when said sewing machine is not operating, said moving means being mounted to said sewing machine and indicating means actuated by said probe for indicating the condition of said bobbin, said moving means includes adjusting means for adjusting the distance said probe is moved into said bobbin housing wherein said indicating means is actuated when said probe moves a predetermined distance.

2. A bobbin thread low detector as claimed in claim 1 wherein said indicating means is actuated when said probe contacts the hub of the bobbin spool.

3. A bobbin thread low detector as claimed in claim 1 wherein said means for moving the probe comprises an air supply, an air cylinder, a solenoid operated air valve for connecting the air cylinder to the air supply and means for actuating said solenoid operated air valve when the sewing machine needle is not being operated.

4. A bobbin thread low detector as claimed in claim 2 wherein said means for moving the probe comprises an air supply, an air cylinder, a solenoid operated air valve for connecting the air cylinder to the air supply and means for actuating said solenoid operated air valve when the sewing machine needle is not being operated.

5. A bobbin thread low detector as claimed in claim 1 wherein said means for moving the probe comprises a coil, a coil core having the probe attached thereto, said coil core being slidingly mounted within said coil and means for energizing said coil when the sewing machine needle is not being operated.

6. A bobbin thread low detector as claimed in claim 2 wherein said means for moving the probe comprises a coil, a coil core having the probe attached thereto, said coil core being slidingly mounted within said coil and means for energizing said coil when the sewing machine needle is not being operated.

7. A bobbin thread low detector as claimed in claim 1 wherein said probe housing comprises a mounting block mounted to said sewing machine, provided with a central opening extending therethrough, said central opening being threaded, an adjustable knob having a threaded outer surface and adapted to engage said central opening of said mounting block, said adjustable knob being provided with an opening extending therethrough, said probe being slidingly retained with said adjustable knob and movable therewith, spring means for maintaining the probe in a lowered unactuated position.

8. A bobbin thread low detector as claimed in claim 1 wherein said means for moving the probe moves the probe only a predetermined distance and wherein said indicating means comprises a fluidic sensing port located within said probe housing, a sensing port closure mounted to said probe and movable therewith so that when said probe is moved the predetermined distance the sensing port will be closed by said port closure, and switch means actuated by the closing of said sensing port for producing an output signal and warning means actuated by said output signal for signalling the sensed condition.

9. A bobbin thread low detector for use in a sewing machine which includes a bobbin spool having a central hub, said bobbin spool being mounted in a bobbin housing in which an opening has been provided, said detector comprising a probe slidably mounted within a probe housing, said probe housing being mounted on the sewing machine such that the probe is aligned with the opening in said bobbin housing, means for moving said probe within said probe housing into and out of said bobbin housing when said sewing machine is not operating, said moving means being mounted to said sewing machine and indicating means actuated by said probe for indicating the condition of said bobbin, said means for moving the probe moves the probe only a predetermined distance and wherein said indicating means comprises a fluidic sensing port located within said probe housing, a sensing port closure mounted to said probe and movable therewith so that when said probe is moved the predetermined distance the sensing port will be closed by said port closure, and switch means actuated by the closing of said sensing port for producing an output signal and warning means actuated by said output signal for signalling the sensed condition.

10. A bobbin thread low detector as claimed in claim 9 wherein said warning means comprises a light.

11. A bobbin thread low detector as claimed in claim 9 wherein said warning means comprises an audible warning device.

12. A bobbin thread low detector for use in a sewing machine which includes a bobbin spool having a central hub, said bobbin spool being mounted in a bobbin housing in which an opening has been provided, said detector comprising a probe slidably mounted within a probe housing, said probe housing being mounted on the sewing machine such that the probe is aligned with the opening in said bobbin housing, means for moving said probe within said probe housing into and out of said bobbin housing when said sewing machine is not operating, said moving means being mounted to said sewing machine and indicating means actuated by said probe for indicating the condition of said bobbin, said probe housing comprising a mounting block mounted to said sewing machine, provided with a central opening extending therethrough, said central opening being threaded, an adjustable knob having a threaded outer surface and adapted to engage said central opening of said mounting block, said adjustable knob being provided with an opening extending therethrough, said probe being slidingly retained within said adjustable knob and movable therewith, spring means for maintaining the probe in a lower unactuated position.

13. A bobbin thread low detector for use in a sewing machine employing a bobbin having a centrally located hub, said bobbin being mounted in a bobbin housing beneath the bed plate forming the work surface of the sewing machine, means defining an opening extending through said bobbin housing, a probe housing mounted to the sewing machine on the same side of the bed plate as said bobbin housing, probe means slidably retained in said probe housing so as to be movable between first and second positions, said probe housing being positioned so that when said probe means is moved between said first position and said second positions at least a portion of said probe means passes through the opening into said bobbin housing toward said bobbin, means for moving said probe means within said probe housing, said moving means further including means for adjusting the location of said second position and indicating means actuated when said probe means moves to said second position for indicating when the thread on said bobbin has been depleated to a predetermined level.

* * * * *